US005771728A

United States Patent [19]

Esposito

[11] Patent Number: 5,771,728

[45] Date of Patent: Jun. 30, 1998

[54] SYSTEM FOR PREPARING WIRES MADE OF STEEL, IRON, OR FERROUS MATERIALS IN GENERAL FOR DRAWING

[76] Inventor: Santo Esposito, Via S. Carlo 15, 24030 Monte Marenzo, Italy

[21] Appl. No.: 748,264

[22] Filed: Nov. 13, 1996

[30] Foreign Application Priority Data

Nov. 22, 1995 [IT] Italy ..... MI95A2428

[51] Int. Cl.[6] ..... B21C 43/02

[52] U.S. Cl. ..... 72/41; 72/46

[58] Field of Search ..... 72/41, 43, 46; 118/420; 226/44

[56] References Cited

U.S. PATENT DOCUMENTS

| | | | |
|---|---|---|---|
| 2,275,794 | 3/1942 | Murphy | 72/46 |
| 2,804,196 | 8/1957 | Planett | 72/41 |
| 3,354,687 | 11/1967 | Manson . | |
| 3,994,445 | 11/1976 | Tarulli | 226/44 |
| 4,412,503 | 11/1983 | Bakewell et al. | 118/420 |

FOREIGN PATENT DOCUMENTS

| | | |
|---|---|---|
| 294 521 | 10/1971 | Austria . |
| 450 886 | 6/1943 | Belgium . |
| 2 359 059 | 2/1978 | France . |
| 1 953 133 | 6/1970 | Germany . |
| 3 611 185 | 12/1987 | Germany . |
| 928 435 | 6/1963 | United Kingdom . |
| 1 165 015 | 9/1969 | United Kingdom . |

*Primary Examiner*—Lowell A. Larson
*Attorney, Agent, or Firm*—Guido Modiano; Albert Josif

[57] ABSTRACT

System for preparing wires made of steel, iron, or ferrous materials in general for drawing which comprises a phosphating station that is substantially constituted by a vat for containing a phosphating solution and by a drum for winding and unwinding the wire to be treated. The drum is at least partially immersed in the phosphating solution and can be actuated with a rotary motion about its own axis to gradually wind the wire to be treated and gradually release the treated wire.

23 Claims, 2 Drawing Sheets

1
2
3
4
5
6
7
8
9
10
11
12
13
13a
14
17
18
19
20
21
23
24
25
26
27
28a
28b
29
30
30a
31
32
33
34
35
36
37
38

SYSTEM FOR PREPARING WIRES MADE OF STEEL, IRON, OR FERROUS MATERIALS IN GENERAL FOR DRAWING

BACKGROUND OF THE INVENTION

The present invention relates to a system for preparing wires made of steel, iron, or ferrous materials in general for drawing.

It is known that medium- and high-quality wires made of steel, iron, or ferrous materials in general that must be drawn must undergo adapted preparatory operations to prevent, during drawing, contact between the wire and the die and consequent seizure and to allow an adapted drawing rate.

These preparatory operations include a first step, known as mordanting, which essentially consists in submerging the wire in a solution of water and sulfuric or hydrochloric acid for a preset time in order to remove lamination scales and surface oxides from the surface of the wire. As an alternative, this operation can be performed by electrolytic pickling, using electrolytic solutions having weak concentrations of sulfuric or hydrochloric acid.

The wire is then cleaned and blown by means of water with continuous replacement and with pressurized air nozzles.

The wire is then subjected to phosphating (bonderizing), which is performed by dipping the wire in a solution of water and zinc salts in an environment that is slightly acid due to phosphoric acid at temperatures that can vary between 50° C. and 85° C. The phosphating operation has the purpose of producing, on the surface of the wire, tightly adhering zinc phosphate crystals that facilitate the adhesion of stearates during drawing, preventing wire-die contact, which would lead to seizure, and allowing the desired drawing rate. After phosphating, the wire is cleaned and blown with hot air so that the wire is dry and ready for subsequent neutralization, which is performed with lime or borax using highly concentrated solutions. Finally, the wire is subjected to further drying and is stored, ready to be drawn.

The systems currently used to perform these operations for preparing the wire for drawing are generally constituted by a plurality of vats, through which the wire is passed to undergo the various operations for pickling, phosphating, and neutralization with borax.

The systems currently being used can be distinguished into continuous-type systems, in which the wire is treated online by virtue of the continuous advancement of the wire in the various vats, and into discontinuous-type systems, in which the various operations for preparing the wire are performed by dipping coils of wire in the various vats in sequence.

Continuous-type systems are generally used to treat semi-finished wires as they leave the patenting oven. These systems are capable of treating a plurality of wires simultaneously and the speed of the preparation process is closely correlated to the rate of advancement of the wire leaving the patenting oven. In order to adapt to the times required to perform the various pickling, bonderizing, and borax neutralization operations it is necessary to use very long vats and considerable amounts of acid solution, with consequent ecological problems for the subsequent neutralization of these substances. With these systems it is therefore necessary to have considerable space available due to the size of the vats and it is also necessary to have a large space available to store the coils after preparation.

In discontinuous-type systems, the coils are dipped individually in side-by-side vats, so as to perform the descaling step, the cleaning step, the phosphating step, an additional cleaning step, the borax neutralization step, and the final cleaning sequentially. In these kinds of system it is necessary to provide a plurality of vats for the phosphating operation, so as to adapt to process and production times. These systems have the problem that they require considerable manual work to perform all the preparatory operations by virtue of lifting units to move the coils from one vat to the other. Even with these types of system, there are problems as regards the space required for the vats and problems linked to neutralizing the large amounts of liquids to be processed; moreover, processing times are long and extended further by the operations for moving the coils from one vat to the other.

SUMMARY OF THE INVENTION

The aim of the present invention is to solve the above described problems by providing a system for preparing wires made of steel, iron, or ferrous materials in general for drawing which requires very small spaces with respect to those required by conventional systems.

Within the scope of this aim, an object of the invention is to provide a system that requires low investments for its execution.

Another object of the invention is to provide a system that allows to considerably reduce the costs for preparing the wire for drawing.

Another object of the invention is to provide a system that is highly flexible in use.

Another object of the invention is to provide a system that can correctly prepare wires for subsequent drawing without requiring large amounts of solutions or treatment liquids, thus reducing the amount of pollutants and the consequent costs for their neutralization.

This aim, these objects, and others that will become apparent hereinafter are achieved by a system for preparing wires made of steel, iron, or ferrous materials in general for drawing, characterized in that it comprises a phosphating station that comprises a vat for containing a phosphating solution and a drum for winding and unwinding the wire to be treated, said drum being at least partially immersed in said phosphating solution and being actuatable with a rotary motion about its own axis to gradually wind the wire to be treated and gradually release the treated wire.

BRIEF DESCRIPTION OF THE DRAWINGS

Further characteristics and advantages of the invention will become apparent from the description of a preferred but not exclusive embodiment of the system according to the invention, illustrated only by way of non-limitative example in the accompanying drawings, wherein.

DESCRIPTION OF THE PREFERRED EMBODIMENTS

Figure 1:
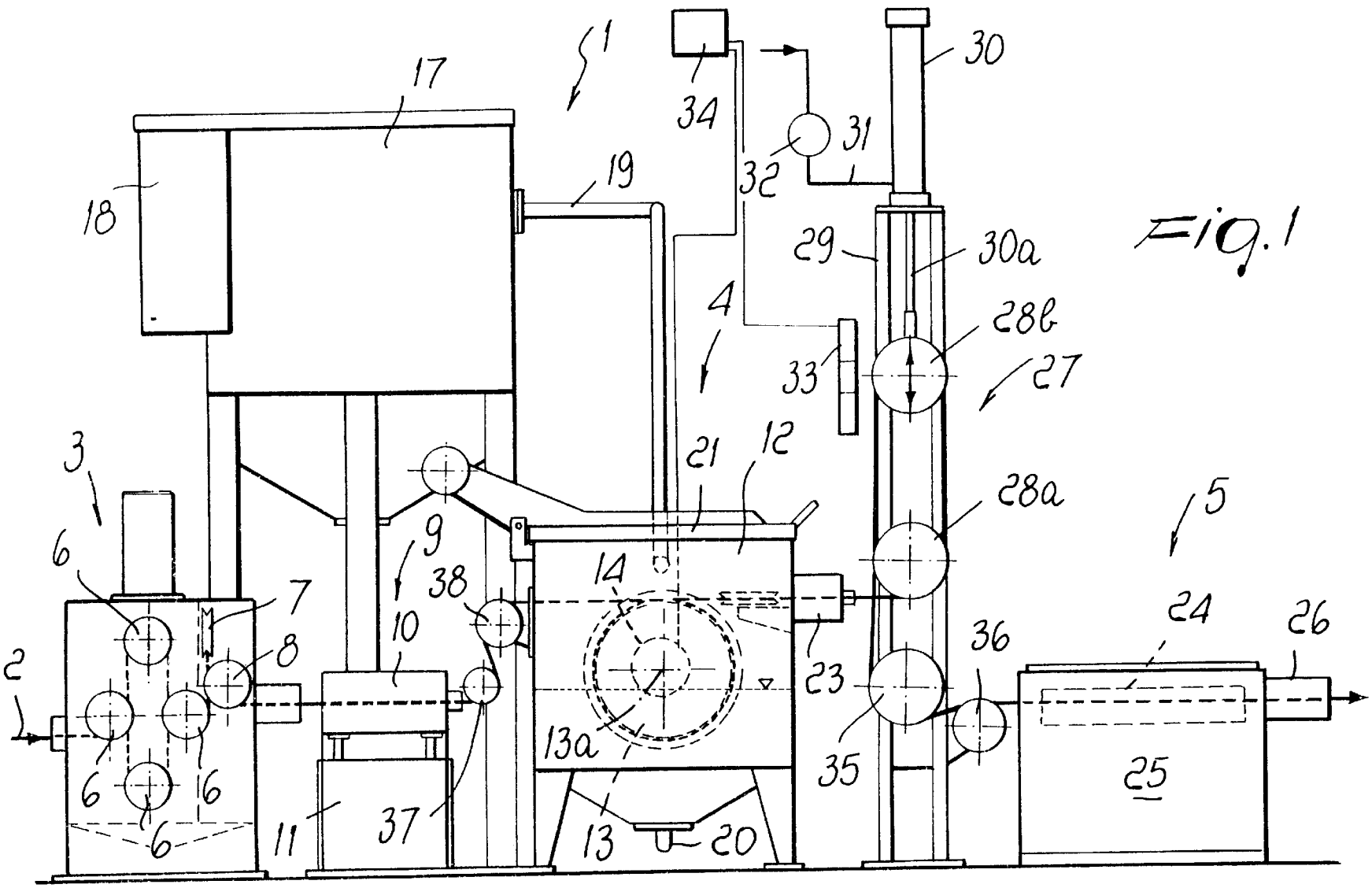
FIG. 1 is a schematic view of the system according to the invention.

With reference to the above figures, the system according to the invention, generally designated by the reference numeral 1, forms a path for the continuous advancement of a wire 2 to be treated, which is made of steel, iron, or ferrous materials in general and runs through a station 3 for mechanical pickling, a station 4 for phosphating (bonderizing) and a station 5 for neutralizing with borax.

More particularly, the pickling station 3 comprises means for deforming the wire 2 around at least two axes that are substantially perpendicular to each other so as to separate the milling scales and the oxides from the surface of the wire 2. These deformation means are constituted, in the illustrated embodiment, by a series of pulleys 6 that are arranged so that their axes are horizontal and are followed by one or more pulleys 7 that are arranged so that their axes are also horizontal but at right angles to the axes of the pulleys 6. When the wire leaves the pulley 7, it is guided, by means of an additional pulley 8, to wire cleaning means that can be constituted by conventional cleaning brushes that are not illustrated for the sake of simplicity.

Downstream of the pickling station 3, along the advancement direction of the wire 2, and before the phosphating station 4, there is a station 9 for cleaning the wire after pickling. Said cleaning station 9 comprises a chamber 10 inside which there are nozzles for delivering jets of water and nozzles for delivering air. A filter 11 is arranged below the chamber 10 to filter the water used in this cleaning step.

The phosphating station 4 comprises, according to the invention, a vat 12 that is adapted to contain the phosphating liquid and a drum 13 on which the wire 2 that arrives from the cleaning station 9 is gradually wound and unwound. The drum 13 is preferably arranged so that its axis 13*a* is horizontal and is partially immersed in the phosphating solution. The drum 13 can be actuated with a rotary motion about its own axis 13*a* by virtue of a variable-speed gearmotor 14.

Figure 2:
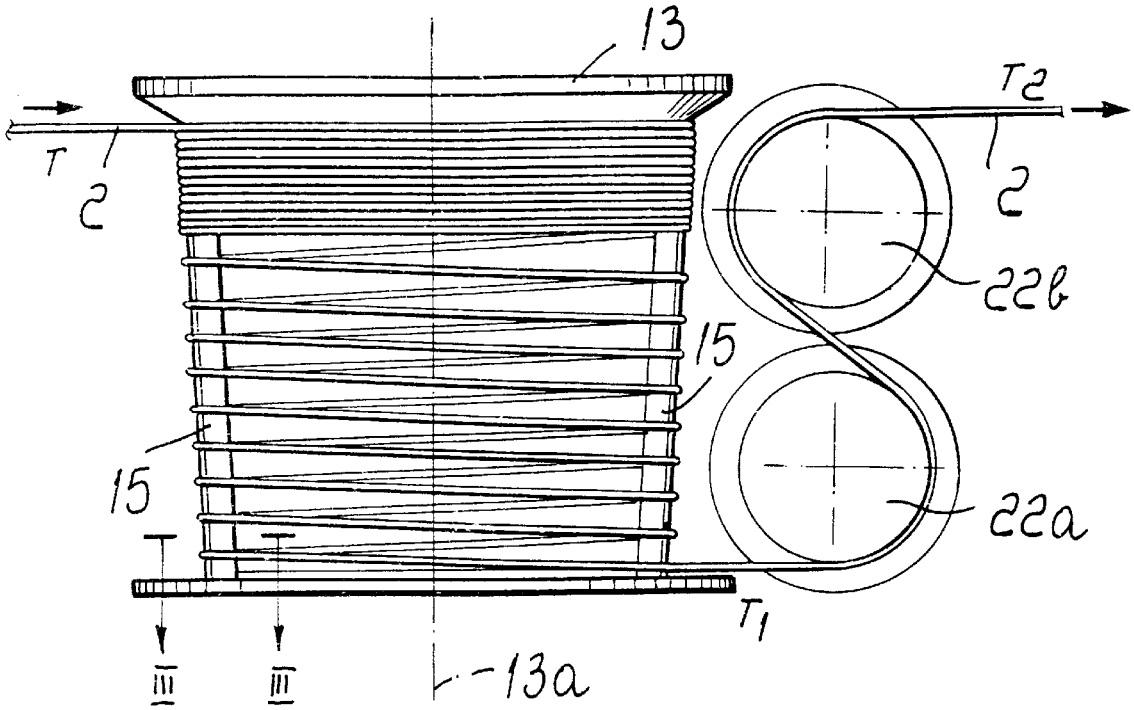
FIG. 2 is a schematic top view of the phosphating station, with the cover removed.

In the drum 13, as shown in particular in FIG. 2, the portion on which the wire 2 is meant to wind is substantially shaped like a truncated cone whose cross-section tapers gradually, starting from the region where the wire starts to be wound and toward the region where said wire is released; said wire winds in turns around the reel 13.

Said frustum-shaped portion where traction is applied is coated with a wearproof material that can be constituted by ceramic material or by an applied part made of hard metal such as Widia (tungsten carbide) or the like.

Furthermore, at least one part of the portion of the drum on which the wire 2 winds has a frame-like structure.

More particularly, said frame-like structure is constituted by a plurality of bars 15 that are mutually spaced about the axis 13*a* of the drum 13 and are orientated along directrices of the frustum-shaped surface of the drum 13.

Figure 3:
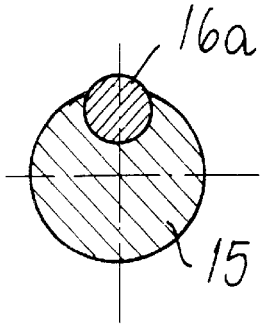
FIGS. 3 to 5 are sectional views, taken along the plane III—III of FIG. 2, of three different embodiments of a detail of the winding and unwinding drum located in the phosphating station.
Figure 4:
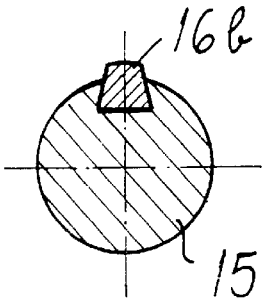
Figure 5:
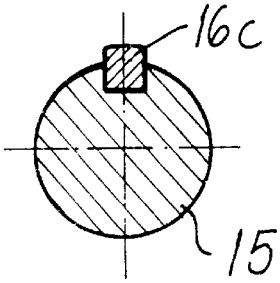

The portions of the bars 15 that are meant to make contact with the wire 2 are conveniently made of a material that is highly resistant to wear and to corrosion by the phosphating solution. As shown in FIGS. 3 to 5, the portions meant to make contact with the wire 2 can be constituted by inserts 16*a*, 16*b*, and 16*c* that may have different shapes according to the requirements and are inserted in adapted seats formed in the body of the bars 15, so as to protrude laterally from the bars in order to make contact with the wire 2 and protect the remaining part of the bars 15 from said contact. These inserts 16*a*, 16*b*, and 16*c* can be constituted, for example, by ceramic materials, sintered metals, or other conventional highly wear- and corrosion-resistant material.

The phosphating solution to be used in the vat 12 is stored inside a reservoir 17 that is also provided with means for heating the solution; said means are constituted for example by a conventional burner 18 that is connected to said reservoir 17. The reservoir 17 is connected to the vat 12 by virtue of means for conveying the phosphating solution from the reservoir 17 to the vat 12 and vice versa, from the vat 12 to the reservoir 17.

Conveniently, said conveying means comprise a duct 19 that connects the reservoir 17 to the vat 12 and leads into the vat 12 above the drum 13, so as to deliver the phosphating liquid, which arrives from the reservoir 17, directly onto the drum 13, on which the wire 2 winds and unwinds continuously.

On the bottom of the vat 12 there is the inlet of a return duct 20, through which the phosphating solution is returned to the reservoir 17 until the iron concentration in said solution makes it practically unusable. At this point the phosphating solution is replaced with fresh solution.

There is also a circuit that is in parallel to said circuit and continuously filters the solution by means of a pump and a filter.

The vat 12 is closed at the top by an openable cover 21.

Means are furthermore arranged inside the vat 12 to reduce the traction applied to the wire 2 between the region where winding on the drum 13 begins and the region where it is released, so as to avoid packing of the wire 2 on the drum 13 and thus facilitate contact between the phosphating solution and the surface of the wire 2. These traction reducing means are constituted by two pulleys 22*a* and 22*b* that are arranged so that their axes are horizontal and mutually parallel and force the wire to undergo a deformation along two mutually opposite curves, so as to reduce the tension T2 applied to the wire that leaves the phosphating station 4 until the tension T1 on the wire that unwinds from the drum 13 is significantly lower than the tension T2 and significantly lower than the tension T that is applied to the wire when it begins to be wound on the drum 13; said tension is determined by the deformations that the wire undergoes during pickling and during its extraction from the drum 13 as a consequence of the actuation of the drum 13 with a rotary motion about its own axis. Owing to the fact that the tension T1 is significantly lower than the tension T, packing of the wire 2 on the drum 13 is effectively avoided and the turns of wire, in the region occupied by the frame-like structure, are kept adequately spaced from each other, thus achieving high effectiveness in the contact between the phosphating liquid and the surface of the wire.

At the output of the phosphating station 4 there are means for cleaning the wire with water and drying it; said means can be constituted, for example, by nozzles for delivering pressurized water jets and hot air, arranged in a chamber 23 that is crossed by the wire that exits from the vat 2.

The borax treatment station 5 comprises an overflow vat 24 that is crossed by the immersed wire 2 and is fed continuously with lime or borax in a highly concentrated solution by means of a pump that draws from an underlying vat 25.

It should be noted that the vat 25 can be kept at an adapted temperature, substantially 75° C., by virtue of the circulation of hot water next to the walls of said vat 25.

At the outlet of the borax treatment station 5 there is a chamber 26 in which there are hot air blower nozzles that dry the wire.

Downstream of the borax treatment station 5, the wire is sent to the drums of the drawing machine, which apply to said wire a traction that also affects the path followed by the wire through the system according to the invention.

Conveniently, in order to make the speed of the drum 13 compatible with the speed of the first drum of the drawing machine, means 27 for compensating the variations in the advancement rate of the wire as it leaves the system are arranged between the phosphating station 4 and the borax treatment station 5.

Said compensating means 27 comprise two pulleys 28*a* and 28*b*, on which the wire that leaves the phosphating station 4 winds; said pulleys are arranged so that their axes are mutually horizontal and parallel. The position of the pulley 28*a* is fixed, whilst the pulley 28*b* can move toward or away from the pulley 28*a*, since it is supported by a structure 29 so that it can slide vertically.

The movement of the pulley 28*b* toward the pulley 28*a* is contrasted by means of a fluid-actuated cylinder 30 that is arranged so that its axis is vertical and is connected to the pulley 28*b* by means of the stem 30*a* of its piston. The fluid-actuated cylinder 30 is conveniently constituted by a pneumatic cylinder that is continuously supplied with pressurized air through a duct 31 on which there is a regulator valve 32 in order to regulate the traction of the wire at the exit from the phosphating vat (T2).

The pulley 28*b* is furthermore controlled by a sensor 33 that detects the movements of the pulley 28*b*, i.e., the variations in the distance between the pulley 28*a* and the pulley 28*b*, and is connected to an actuation and control element 34 that supervises the operation of the machine. The actuation and control element 34 is connected to the gearmotor 14 so as to vary the actuation rate of the drum 13 to adapt said rate to the advancement rate of the wire set by the drawing system.

A guiding pulley 35 is arranged below the pulley 28*a*, and means for detecting the advancement rate of the wire are arranged between said pulley 35 and the inlet of the borax treatment station 5; said detector means can be constituted, for example, by an encoder that is mounted on the shaft of a pulley 36. The encoder mounted on the pulley 36 is also connected to the actuation and control element 34, which thus constantly controls the advancement rate of the wire 2, varying the actuation rate of the drum 13 if necessary.

For the sake of completeness in description, it should be noted that an additional pair of guiding pulleys, designated by the reference numerals 37 and 38, is arranged along the path of the system and more particularly between the cleaning station 9 and the phosphating station 4.

The operation of the system according to the invention is as follows.

The wire 2, pulled by the rotary actuation of the drum 13 with a motion about its own axis 13*a* and by the drawing system, gradually passes through the pickling station 3, where the deformation of the wire about two mutually perpendicular axes removes the milling scales and the oxides produced during the previous production processes from the surface of the wire. The wire 2 that leaves the pickling station 3 is optionally subjected to mechanical brushing, which completes the removal of the milling scales and of the oxides.

The wire 2 is then cleaned in the cleaning station 9 and dried with air jets. In the phosphating station 4, the wire 2, by gradually winding on the drum 13 and gradually unwinding from it, is subjected to the action of the phosphating solution. It should be noted that the movement of the drum 13 about its own axis, the fact that said drum is partially immersed in the phosphating solution, the fact that the phosphating solution is fed to the vat 12 from above so that the phosphating solution falls onto the wire 2 wound on the drum 13, as well as the particular path followed by the wire that winds on the drum 13, achieve particular effectiveness in phosphating. Owing to the presence of the two pulleys 22*a* and 22*b* it is possible to maintain limited traction on the wire during its unwinding from the drum 13, which as mentioned effectively avoids the packing of the wire on the drum 13, and a higher traction on the wire 2 that leaves the phosphating station 4, which allows optimum operation of the compensating means 27. At the exit from the phosphating station 4, the wire is cleaned and dried in the chamber 23 and then subjected to treatment with borax by passing through the vat 24. Finally, in passing through the chamber 26, the wire is dried and is ready to enter the die.

The system according to the invention for feeding conventional dies requires very small spaces, since it does not require the use of bulky vats to perform pickling and phosphating.

Furthermore, by virtue of this fact the system according to the invention is capable of operating by using smaller amounts of phosphating solutions, generating less pollution problems and furthermore reducing costs for the treatment of these solutions when they are no longer used.

It should also be noted that by virtue of the high effectiveness achieved with the phosphating station of the system according to the invention it is possible to use phosphating solutions having very low concentrations, with additional savings both in terms of raw material and in terms of disposal of the solutions.

In practice, it has been observed that the system according to the invention fully achieves the intended aim, since it requires limited investments, is easy to manage and highly flexible in use, and occupies far less space than conventional systems for preparing the wire for drawing.

The system thus conceived is susceptible of numerous modifications and variations, all of which are within the scope of the inventive concept; all the details may furthermore be replaced with other technically equivalent elements.

In practice, the materials employed, as well as the dimensions, may be any according to the requirements and the state of the art.

What is claimed is:

1. A system for preparing wires made of steel, iron, or ferrous materials in general for drawing, including a phosphating station, said phosphating station comprising: a vat for containing a phosphating solution; and a drum for winding and unwinding a wire to be treated, said drum being at least partially immersed in said phosphating solution and being actuable with a rotary motion about an axis thereof, for gradually releasing the treated wire, wherein said drum has a portion on which the wire is meant to wind which is shaped like a truncated cone whose cross-section tapers gradually, starting from a region where the wire starts to be wound and toward a region where said wire is released, traction reducing means being provided to reduce the traction applied to the wire between the region where winding on the drum begins and the region where the wire is released, to avoid packing of the wire on the drum and facilitating contact between the phosphating solution and each portion of the wire.

2. The system according to claim 1, wherein the axis of said drum is substantially horizontal.

3. The system according to claim 1, comprising a variable-speed gearmotor for actuating said drum to rotate about said axis thereof.

4. The system according to claim 1, wherein said wire winding portion substantially shaped like a truncated cone is covered with wearproof material selected from any of a ceramic material and applied hard metal, such as Widia (tungsten carbide).

5. The System according to claim 1, wherein at least part of the region where the wire begins to wind has a frame-like structure constituted by a plurality of bars, said bars being orientated along directrices of said truncated cone surface and being spaced one from the other about the axis of the drum, said bars including portions thereof for making contact with the wire, said contact portions being made of a material that is highly resistant to wear and to corrosion by the phosphating solution.

6. The system according to claim 1, comprising: a reservoir for containing the phosphating solution; and conveying means for conveying the phosphating solution from said reservoir to said vat accommodating said drum, and from said vat to said reservoir.

7. The system according to claim 6, wherein said conveying means comprises a duct for connecting said reservoir to said vat that accommodates said drum, said connecting duct leading into said vat in a region above said drum.

8. The system according to claim 6, wherein said reservoir is provided with heating means for heating the phosphating solution.

9. The system according to claim 1, comprising a cleaning station for mechanical cleaning of the wire, said cleaning station being arranged upstream of said phosphating station along a wire advancement direction.

10. The system according to claim 1, comprising upstream of said phosphating station, a pickling station, said pickling station comprising wire deforming means for deforming the wire about at least two axes, said at least two axes being substantially perpendicular to each other.

11. The system according to claim 10, wherein said pickling station comprises wire cleaning brushes, said brushes being located at an exit region of said deforming means.

12. The system according to claim 10, wherein a wire cleaning station is arranged between said pickling station and said phosphating station.

13. The system according to claim 12, wherein said cleaning station comprises means for cleaning the wire with water and drying means.

14. The system according to claim 1, comprising a borax treatment station, said borax treatment station being arranged downstream of said phosphating station along a wire advancement direction.

15. The system according to claim 14, wherein said borax treatment station comprises an overflow vat, said overflow vat being supplied with borax, the wire passing through said overflow vat, so as to be immersed in said borax.

16. The system according to claim 14, comprising wire rate compensating means for compensating variations in advancement rate of the wire leaving the system, said wire rate compensating means being arranged between said phosphating station and said borax treatment station.

17. The system according to claim 16, wherein said compensating means comprise two pulleys for winding the wire at exiting from said phosphating station, said pulleys being arranged with axes thereof being mutually parallel, a first one of said pulleys being movable toward a second one, in contrast with a resisting force.

18. The system according to claim 17, comprising a fluid-actuated cylinder, said fluid-actuated cylinder acting on said first movable pulley for contrasting its movement toward the second pulley.

19. The system according to claim 18, wherein said fluid-actuated cylinder is constituted by a pneumatic cylinder.

20. The system according to claim 17, wherein said compensating means comprise a sensor for detecting change of distance between said two pulleys, said sensor being operatively connected to an actuation and control element, said actuation and control element operating to vary actuation rate of said drum as a function of a variation of said distance.

21. The system according to claim 20, comprising detecting means for detecting advancement rate of the wire, said detecting means being located at an inlet region of said borax treatment vat and connected to said actuation and control element.

22. The system according to claim 1, wherein cleaning and drying means for cleaning and drying the wire are provided, said cleaning and drying means being located at an exit of said phosphating station along an advancement direction of the wire.

23. The system according to claim 22, wherein said cleaning and drying means are constituted by nozzles for delivering jets of pressurized water and hot air.

* * * * *